US008028881B2

(12) United States Patent
Ronn et al.

(10) Patent No.: US 8,028,881 B2
(45) Date of Patent: Oct. 4, 2011

(54) NAILER STRIKE PLATE

(75) Inventors: John Ronn, Arlington Heights, IL (US); Marco Laubach, Wheeling, IL (US); Darius Smolinski, Chicago, IL (US); Kuo Lun Hung, Sinjhuang (TW); Mu-Yin Chu, Taipei (TW)

(73) Assignee: Robert Bosch GmbH, Stuttgart (DE)

( * ) Notice: Subject to any disclaimer, the term of this patent is extended or adjusted under 35 U.S.C. 154(b) by 273 days.

(21) Appl. No.: 12/389,463

(22) Filed: Feb. 20, 2009

(65) Prior Publication Data

US 2010/0213234 A1 Aug. 26, 2010

(51) Int. Cl.
*B25C 1/04* (2006.01)

(52) U.S. Cl. ..... 227/130; 227/8; 227/10; 227/61; 227/147; 227/156; 81/20; 81/26; 81/44; 81/463

(58) Field of Classification Search ..... 227/8, 10, 227/130, 61, 147, 156; 81/44, 463, 20, 26
See application file for complete search history.

(56) References Cited

U.S. PATENT DOCUMENTS

| | | | | |
|---|---|---|---|---|
| 4,197,974 | A | 4/1980 | Morton | |
| 4,404,894 | A | 9/1983 | Oesterle | |
| 5,560,528 | A * | 10/1996 | Chen | 227/130 |
| 5,715,986 | A | 2/1998 | Sauer | |
| 5,878,936 | A * | 3/1999 | Adachi et al. | 227/130 |
| 6,059,166 | A | 5/2000 | Ho et al. | |
| 6,199,383 | B1 | 3/2001 | Pusateri | |
| 6,296,168 | B1 | 10/2001 | Hung | |
| 6,419,141 | B1 | 7/2002 | Wang | |
| 6,671,931 | B1 | 1/2004 | Duncan | |
| 7,341,173 | B1 | 3/2008 | Arnold | |
| 7,344,058 | B2 | 3/2008 | Bruins et al. | |
| 7,475,800 | B2 * | 1/2009 | Liang | 227/130 |
| 7,686,198 | B2 * | 3/2010 | Liang et al. | 227/130 |
| 2006/0016844 | A1 * | 1/2006 | Ishizawa et al. | 227/130 |
| 2008/0290132 | A1 * | 11/2008 | Liang | 227/130 |

OTHER PUBLICATIONS

European Search Report in corresponding European patent application (i.e., EP 10153507), mailed Dec. 2, 2010, 2 pages.

* cited by examiner

*Primary Examiner* — Sameh H. Tawfik
*Assistant Examiner* — Michelle Lopez
(74) *Attorney, Agent, or Firm* — Maginot, Moore & Beck

(57) ABSTRACT

A device for impacting a fastener in one embodiment includes a housing with an upper housing portion, a middle housing portion, and a side housing portion extending between the upper housing portion and the middle housing portion, a drive cylinder configured to vent within the housing, an air passage extending through the housing and including a mouth at the upper housing portion, and a strike plate extending over the upper housing portion and including a top portion positioned apart from the upper housing portion, and a first side extension extending downwardly from the top portion along the side housing portion to a location above and spaced apart from an outwardly extending first surface of the middle housing portion.

20 Claims, 3 Drawing Sheets

NAILER STRIKE PLATE

FIELD OF THE INVENTION

This invention relates to the field of devices used to drive fasteners into work pieces and particularly to a device for impacting fasteners into work pieces.

BACKGROUND

Fasteners such as nails and staples are commonly used in projects ranging from crafts to building construction. While manually driving such fasteners into a work piece is effective, a user may quickly become fatigued when involved in projects requiring a large number of fasteners and/or large fasteners. Moreover, proper driving of larger fasteners into a work piece frequently requires more than a single impact from a manual tool.

In response to the shortcomings of manual driving tools, power-assisted devices for driving fasteners into wood and other materials have been developed. Contractors and homeowners commonly use such devices for driving fasteners ranging from brad nails used in small projects to common nails which are used in framing and other construction projects. Compressed air has been traditionally used to provide power for the power-assisted devices. Specifically, a source of compressed air is used to actuate a piston assembly which impacts a nail into the work-piece.

In addition to driving fasteners, however, manual impacting devices are frequently used to move or adjust the position of a work piece prior to fastening the work piece. This practice is particularly common in stick framing where wood may be misaligned for a number of different reasons. In such situations, a user taps or strikes the work piece with a hammer until the work piece is properly aligned. The aligned work piece is then fastened in position. With the onset of pneumatic nailers, manual impacting devices are not always readily available. Accordingly, rather than climbing down from a work site and retrieving a hammer, many users simply use the pneumatic device as a manual impacting device. Since most pneumatic devices include a substantial amount of metal, users generally believe the pneumatic device to be able to withstand the manual impacting forces.

The top of a pneumatic nailer is typically somewhat flat and can be used as a manual impacting tool without exposing the hands of the user to the impact. Thus, users frequently use the top portion of the pneumatic tool housing as an impacting surface. The housing of pneumatic tools, however, is not commonly designed to withstand impacting forces. For example, pneumatic nailers are typically vented through the top of the device. In order to prevent blowing air into the face of the user, a deflector is positioned on the top of the pneumatic nailer to direct the vented air away from the user. The deflector may be mounted to the upper housing of the tool or the deflector may be formed integrally with the device housing.

In either event, the deflector, which is inherently weaker than other parts of the pneumatic nailer housing, is the part of the pneumatic nailer most frequently used as an impacting device. Thus, while repeated impacts can result in damage to various part of the tool and parts of the tool may even break off, the deflector is one of the most frequently damaged components of a pneumatic nailer.

What is needed is a device incorporating an element which can be used to absorb energy from an impact. What is further needed is a device incorporating an element which is simple, reliable, lightweight, and compact. A further need exists for a device that incorporates an energy absorbing element that has a long useful lifetime and that does not require extensive redesign of the device.

SUMMARY

In accordance with one embodiment, there is provided a device for impacting a fastener that includes a housing with an upper housing portion, a middle housing portion, and a side housing portion extending between the upper housing portion and the middle housing portion, a drive cylinder configured to vent within the housing, an air passage extending through the housing and including a mouth at the upper housing portion, and a strike plate extending over the upper housing portion and including a top portion positioned apart from the upper housing portion, and a first side extension extending downwardly from the top portion along the side housing portion to a location above and spaced apart from an outwardly extending first surface of the middle housing portion.

In accordance with another embodiment, there is provided a device for impacting a fastener including a housing with an upper housing portion, a middle housing portion, and a side housing portion extending between the upper housing portion and the middle housing portion, a drive cylinder configured to vent within the housing, an air passage extending through the housing and configured to vent the housing, a strike plate extending over the upper housing portion and including a top portion, and a first side extension extending downwardly from the top portion along the side housing portion to a location above and spaced apart from an outwardly extending first surface of the middle housing portion, and a gasket positioned between the upper housing portion and the top portion of the strike plate.

In accordance with a further embodiment, a device for impacting a fastener includes a housing including an upper housing and a lower housing, a drive cylinder positioned within the housing and configured to vent into the housing, an air passage extending from within the housing to without the housing, a strike plate including a top surface positioned above the upper housing, and a first side extension extending downwardly from the top surface toward the lower housing to a location above and spaced apart from a horizontal surface of the upper housing, and a gasket positioned between the top of the upper housing and the top surface of the strike plate.

DESCRIPTION

Figure 1:
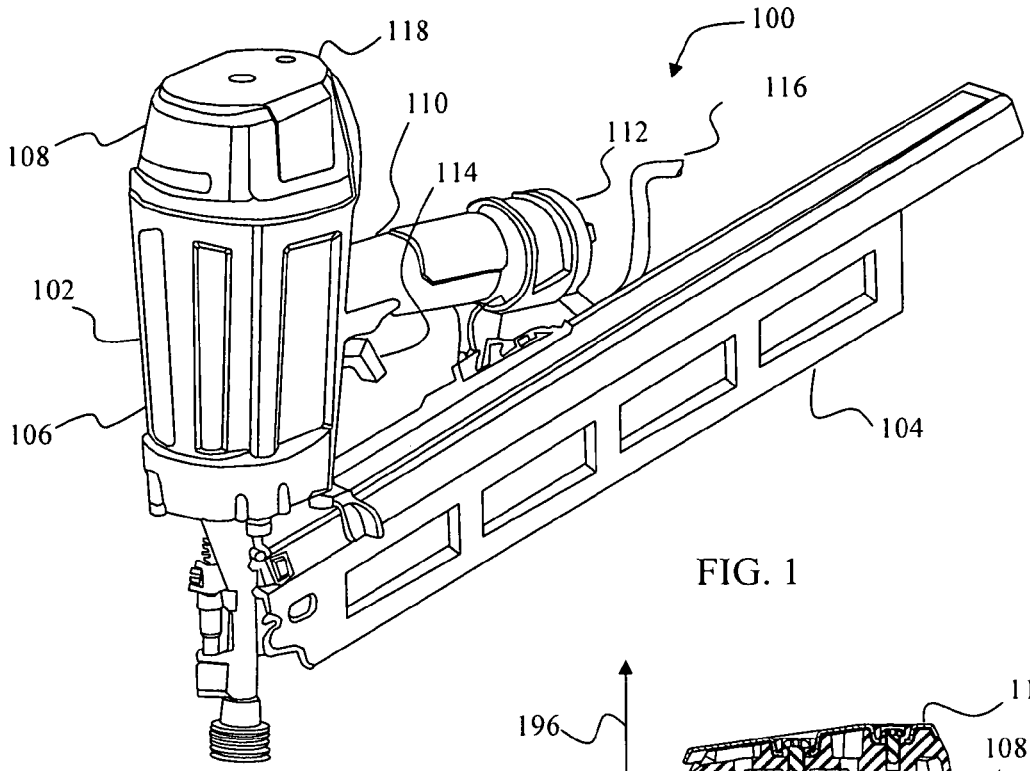
FIG. 1 depicts a front perspective view of a fastener impacting device in accordance with principles of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

FIG. 1 depicts a fastener impacting device 100 including a housing 102 and a fastener cartridge 104. The housing 102 includes a lower housing 106 and an upper housing 108. The housing 102 further defines a handle portion 110, and an air receptacle portion 112. A trigger 114 extends outwardly from the housing 102 and controls the supply of compressed air which is provided from a source of compressed air through an air supply hose 116. A strike plate 118 is located at the upper end portion of the upper housing 108.

Figure 2:
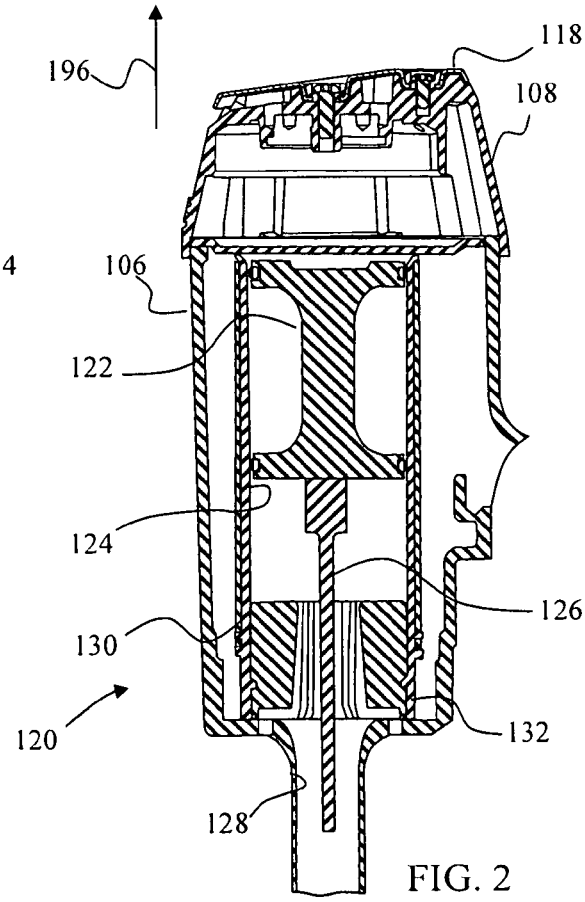
FIG. 2 depicts a partial simplified side cross sectional view of the drive section of the fastener impacting device of FIG. 1.

The fastener cartridge 104 in this embodiment is spring biased to force fasteners, such as nails or staples, serially one after the other, into a loaded position adjacent a drive section 120, shown in FIG. 2, within the lower housing 106. The drive section 120 includes a piston 122 located within a drive cylinder 124. A drive blade 126 is located at one end of the piston 122 and aligned with a drive channel 128 into which a fastener to be driven is forced by the fastener cartridge 104. A bumper 130 is positioned at the end portion 132 of the cylinder 124 which opens to the drive channel 128.

Figure 3:
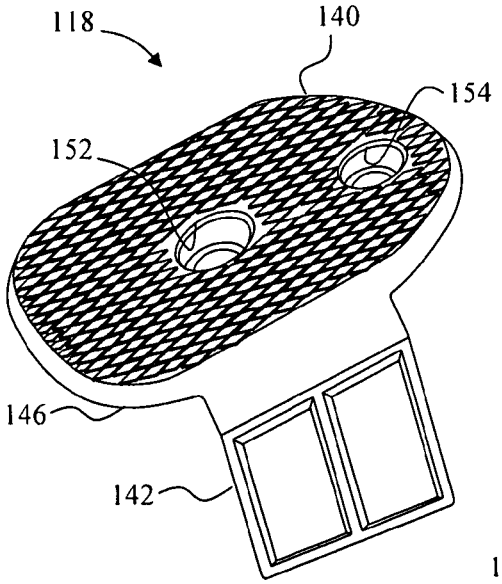
FIG. 3 depicts a top perspective view of the strike plate of the device of FIG. 1.
Figure 4:
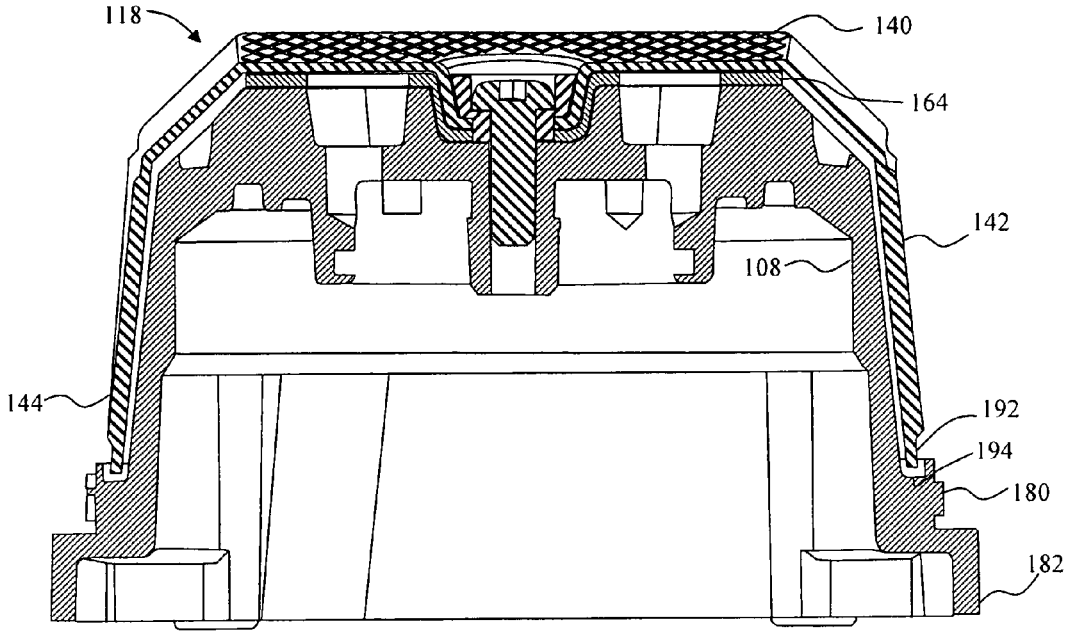
FIG. 4 depicts a front cross sectional view of the upper housing of the device of FIG. 1 showing a strike plate spaced apart from the upper housing by a gasket, the strike plate including extensions which terminate above an outwardly extending surface of the flange of the housing.
Figure 5:
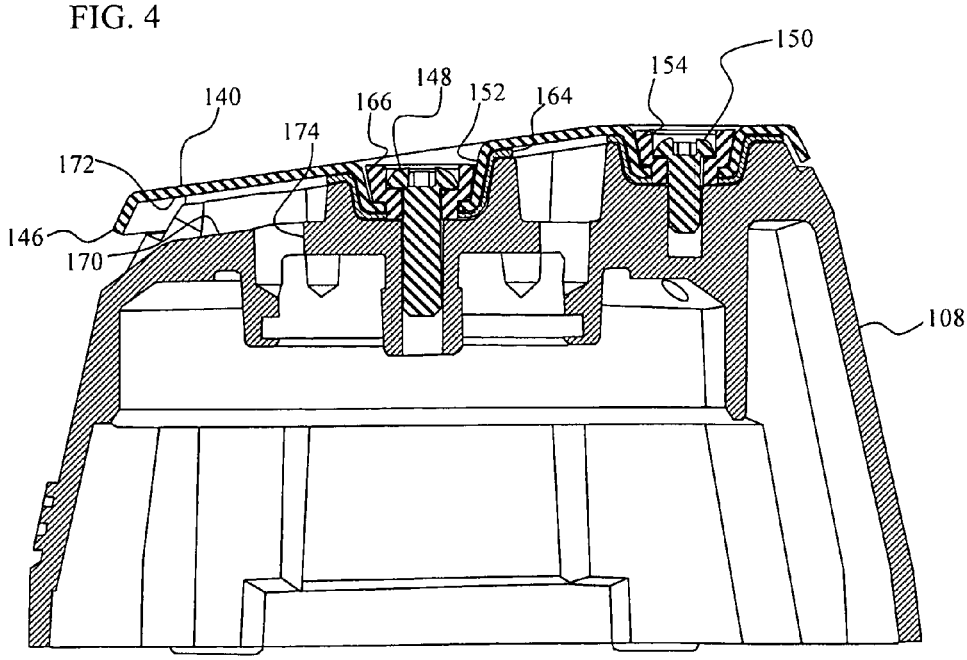
FIG. 5 depicts a side cross sectional view of the upper housing of the device of FIG. 1 showing a rib of the strike plate, the strike plate fastened to the upper housing by two fasteners.

The strike plate 118, shown in additional detail in FIGS. 3-5, includes a top surface 140 and two extensions 142 and 144. The top surface 140 is textured and surrounded by a rib 146 which provides additional strength for the strike plate 118. The strike plate 118 is attached to the upper housing 108 by two fasteners 148 and 150 inserted through two fastener wells 152 and 154 in the strike plate 118. The wells 152 and 154 are used to attach the strike plate 118 to the upper housing 108 as discussed with further reference to the fastener well 152 shown in FIG. 6.

The fastener well 152 of the strike plate 118 is positioned within a fastener well 158 of the upper housing 108. A fastener bore 160 is located at a lower portion of the well 152. A gasket 164 extends along the housing 108. A cup 166 is located within the fastener well 152 and includes a lip 168 that extends downwardly through the fastener bore 160 to a location adjacent the gasket 164 and abutting the housing 108. The fastener 148 clamps the cup 166 against the fastener well 152 and against the housing 108. The gasket 164 is formed to maintain a passage 170 between the upper housing 108 and the underside 172 of the top surface 140 between a vent 174 and the atmosphere. The vent 174 provides an air passage venting the interior of the housing 102 to atmosphere. Additional vents and passages may be provided.

Figure 7:
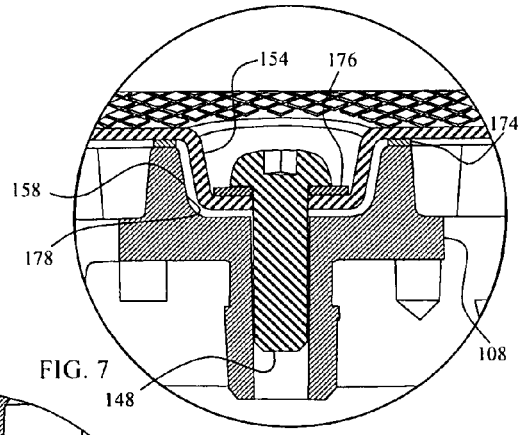
FIG. 7 depicts a partial side cross sectional view of the upper housing of the device of FIG. 1 with a fastener extending through the strike plate with an alternative gasket positioned between the strike plate and the upper housing.
Figure 8:
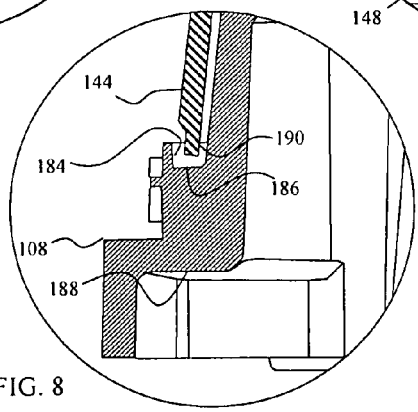
FIG. 8 depicts a partial front cross sectional view of an extension extending into a channel and spaced apart from a horizontal surface of the housing by a gap.

If desired, the gasket 164 may be formed to extend between the upper housing 108 and the strike plate 118 along the two extensions 142 and 144. Moreover, FIG. 7 depicts a configuration of a gasket 174 that may be used with the fastener impacting device 100. In FIG. 7, the gasket 174 terminates prior to extending into the fastener well 158 of the upper housing 108 and a washer 176 is located between the fastener 148 and the strike plate 118. The thickness of the gasket 174, the depth of the fastener well 152, and the depth of the fastener well 158 are selected to establish an air gap 178 between the fastener well 152 and the fastener well 158.

Figure 6:
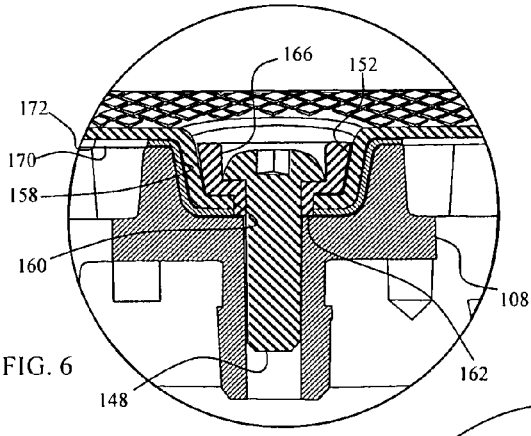
FIG. 6 depicts a partial side cross sectional view of the upper housing of the device of FIG. 1 with a fastener extending through the strike plate and gasket.

Returning to FIG. 4, the extensions 142 and 144 extend from the top surface 140 along the side of the upper housing 108 to a flange 180 located at a lower portion 182 of the upper housing 108. The flange 180 includes a channel 184 with a bottom 186. The bottom 186 of the channel 184 is located opposite and parallel to a ledge 188 on the inside of the housing 108 which contacts an upper surface of the lower housing 106. As shown in FIG. 6, the extension 144 includes a base portion 190 which is spaced apart from, and substantially perpendicular to, the bottom 186 of the channel 184. The extension 142 also includes a base portion 192 which is spaced apart from a channel bottom 194.

With reference to FIG. 2, an operator using the fastener impacting device 100 as a manual impacting device on an object (not shown) will move the fastener impacting device in the direction of the arrow 196. Accordingly, the strike plate 118 will impact the object (not shown). Upon impact, a force opposite to the direction of the arrow 196 will be generated on the top surface 140 of the strike plate 118. The strike plate 118 in this embodiment is made from a stainless steel sheet. Accordingly, the impacting force is initially translated into movement of the strike plate 118 toward the housing 108.

Movement of the strike plate 118 results in compression of the gasket 164 against the upper housing 108. In one embodiment, the gasket 164 is formed using a urethane material. Other materials that may be used as a gasket material include natural rubber and microcellular polyurethane elastomer (MPE). MPEs form a material with numerous randomly oriented air chambers. Some of the air chambers are closed and some are linked. Additionally, the linked air chambers have varying degrees of communication between the chambers and the orientation of the linked chambers varies. Accordingly, when the MPE structure is compressed, air in the chambers is compressed. As the air is compressed, some of the air remains within various chambers, some of the air migrates between other chambers and some of the air is expelled from the structure. MPEs thus exhibit good impact absorbing characteristics. One such MPE is MH 24-65, commercially available from Elastogran GmbH under the trade name CELLASTO®.

As the gasket 164 is compressed, some of the impact force is absorbed. Additionally, because the strike plate 118 is relatively stiff, the impact force transmitted to the gasket 164 is not concentrated at a small area of the gasket 164. Accordingly, any force acting through the top of the upper housing 108 is spread over a large surface area of the upper housing 108.

Additionally, as the strike plate 118 is forced toward the upper housing 108, the extensions 142 and 144 move closer to the flange 180, narrowing the gap between the base portions 190 and 192 and the channel bottoms 186 and 194. In this embodiment, the thickness of the gasket 164 is selected to be slightly less than the initial gap between the base portions 190 and 192 and the channel bottoms 186 and 194. Accordingly, as the gasket 164 approaches full compression, the base portions 190 and 192 contact the channel bottoms 186 and 194, respectively. Accordingly, any residual energy is transferred directly from the base portions 190 and 192 to the channel bottoms 186 and 194.

The lower portion 182 of the upper housing 108 is relatively thick and is thus able to absorb increased amounts of force. Moreover, because the ledge 188 is positioned directly in line with an upper surface of the lower housing 106, force is readily transmitted into the lower housing 106. Depending upon the particular materials and design, the foregoing sequence of events may differ. Accordingly, by varying the thickness of the gasket 164 and the gap between the base portions 190 and 192 and the channel bottoms 186 and 194, along with selection of specific materials for the strike plate 118 and the gasket 164, selective amounts of impact force may be directed away from the top of the housing 108.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

The invention claimed is:

1. A device for impacting a fastener comprising:

a housing including an upper housing portion, a middle housing portion, and a side housing portion extending between the upper housing portion and the middle housing portion;

a drive cylinder configured to vent within the housing;

an air passage extending through the housing and including a mouth at the upper housing portion; and a strike plate extending over the upper housing portion and including a top portion positioned apart from the upper housing portion, and a first side extension extending downwardly from the top portion along the side housing portion, wherein the device is configured such that the first side extension is maintained at a first location above and spaced apart from an outwardly extending first surface of the middle housing portion, and movable to a second location whereat the first side extension is in contact with the first surface in response to a force applied to the strike plate.

2. The device of claim 1, further comprising:

a gasket positioned between the upper housing portion and the top portion of the strike plate.

3. The device of claim 2, wherein the gasket has a thickness, and the first side extension of the strike plate is maintained at the first location by a distance substantially equal to the thickness of the gasket.

4. The device of claim 2, further comprising:

a flange extending about a circumference of the middle housing portion and defining the first surface;

a second surface of the flange located below the first surface; and an upper surface of a lower housing positioned adjacent to the second surface, wherein each of the first surface, the second surface, and the upper surface are substantially parallel to each other.

5. The device of claim 1, further comprising:

a rib extending about the top portion of the strike plate.

6. The device of claim 1, further comprising:

a flange extending about a circumference of the middle housing portion and defining the first surface; and a lip extending upwardly from the first surface and defining a channel, the first side extension of the strike plate extending to a location within the channel.

7. The device of claim 1, further comprising:

a second side extension extending downwardly from the top portion along the side housing portion to a location above and spaced apart from a second surface of the middle housing portion, the second side extension extending from a side of the top portion opposite to the side of the top portion from which the first side extension extends.

8. A device for impacting a fastener comprising:

a housing including an upper housing portion, a middle housing portion, and a side housing portion extending between the upper housing portion and the middle housing portion;

a drive cylinder configured to vent within the housing;

an air passage extending through the housing and configured to vent the housing;

a strike plate extending over the upper housing portion and including a top portion, and a first side extension extending downwardly from the top portion along the side housing portion to a location above and spaced apart from an outwardly extending first surface of the middle housing portion; and a gasket positioned between the upper housing portion and the top portion of the strike plate, the gasket compressably maintaining the first side extension at the location above and spaced apart from an outwardly extending first surface, such that the first side extension is movable toward the first surface when a force is applied to an upper surface of the strike plate.

9. The device of claim 8, wherein the top portion is textured.

10. The device of claim 8, wherein the gasket has a thickness, and the first side extension of the strike plate is compressably maintained at the location above and spaced apart from the first surface of the middle housing portion by a distance substantially equal to the thickness of the gasket.

11. The device of claim 8, wherein:

the strike plate is comprised of stainless steel; and the gasket is comprised of urethane.

12. The device of claim 11, wherein:

the upper housing portion defines a housing fastener bore;

the housing fastener bore is located within a housing fastener bore well extending away from the top portion;

the top portion defines a strike plate fastener bore aligned with the housing fastener bore; and the strike plate fastener bore is located within a strike plate fastener bore well extending toward the upper housing portion.

13. The device of claim 12, wherein:

the gasket extends completely about the housing fastener bore well but not into the housing fastener bore well.

14. The device of claim 8, further comprising:

a second side extension extending downwardly from the top portion along the side housing portion to a location above and spaced apart from a second surface of the middle housing portion, the second side extension extending from a side of the top portion opposite to the side of the top portion from which the first side extension extends.

15. A device for impacting a fastener comprising:

a housing including an upper housing portion and a lower housing portion;

a drive cylinder positioned within the housing and configured to vent into the housing;

an air passage configured to vent the housing;

a strike plate including a top surface positioned above the upper housing portion, and a first side extension extending downwardly from the top surface toward the lower housing portion to a location above and spaced apart from a horizontal surface of the housing; and a gasket positioned between an upper surface of the upper housing portion and the top surface of the strike plate, the gasket compressably maintaining the strike plate spaced apart from the upper housing portion, such that the strike plate is movable toward the upper housing portion when a downward force is applied to the top surface of the strike plate.

16. The device of claim 15, wherein:

the upper housing portion includes a housing bore:

the strike plate includes a strike plate bore;

a fastener extends through the strike plate bore and the housing bore; and a cup includes a lower lip extending through the strike plate bore.

17. The device of claim 16, wherein the housing bore is located within a housing bore well extending away from the top surface;

the strike plate bore is located within a strike plate bore well extending toward the upper housing.

18. The device of claim 15, further comprising:

a second side extension extending downwardly from the top surface toward the lower housing portion from a side of the top surface opposite to the side of the top surface from which the first side extension extends.

19. The device of claim 18, further comprising:

a flange extending about a circumference of the housing and defining the horizontal surface;

a second surface of the flange located below the horizontal surface and generally parallel to the horizontal surface; and an upper surface of a lower housing positioned adjacent to the second surface.

20. The device of claim 19, wherein the first side extension, the horizontal surface, the second surface and the upper surface are aligned.

* * * * *